US005443694A

United States Patent [19]

Hippe et al.

[11] Patent Number: 5,443,694

[45] Date of Patent: Aug. 22, 1995

[54] METHOD OF RESTORING HEATING WALLS OF COKE OVEN BATTERY

[75] Inventors: Werner Hippe, Gladbeck; Günter Meyer, Essen; Martin Reinke, Dortmund, all of Germany

[73] Assignee: Krupp Koppers GmbH, Essen, Germany

[21] Appl. No.: 120,575

[22] Filed: Sep. 10, 1993

[30] Foreign Application Priority Data

Sep. 24, 1992 [DE] Germany ..... 42 31 922.6

[51] Int. Cl.[6] ..... C10B 29/00; F27D 1/16

[52] U.S. Cl. ..... 201/41; 202/223; 202/267.1; 264/30

[58] Field of Search ..... 201/41; 202/222, 223, 202/267.1, 268; 264/30

[56] References Cited

U.S. PATENT DOCUMENTS

| | | | |
|---|---|---|---|
| 4,059,885 | 11/1977 | Oldengott | 202/267.1 |
| 4,373,244 | 2/1983 | Mertens et al. | 202/267.1 |
| 4,445,977 | 5/1984 | Husher | 202/223 |
| 4,545,860 | 10/1985 | Lyskawa et al. | 201/41 |
| 5,227,106 | 7/1993 | Kolvek | 264/30 |

*Primary Examiner*—W. Gary Jones
*Assistant Examiner*—Steven P. Griffin
*Attorney, Agent, or Firm*—Michael J. Striker

[57] ABSTRACT

Renovation of a heating wall, in particular a heating wall head of a coke oven battery, includes starting with reconstruction of the wall to be renovated on a wall protective plate of the part, abutting a new masonry exactly on the wall protective plate, and arranging between the new masonry and the old masonry a vertically extending welding joint for sealing the ceramic welding after heating up the new masonry, which means after reaching final thermal expansion of the new masonry.

3 Claims, 3 Drawing Sheets

METHOD OF RESTORING HEATING WALLS OF COKE OVEN BATTERY

BACKGROUND OF THE INVENTION

The present invention relates to a method of restoring heating walls of a coke oven battery.

For restoration or repair of the heating walls of a coke oven battery it is known to design the heating wall in which the old and the new masonry are separated from one another by a vertically extending slip joint. Moreover, when it is necessary to restore the head heating joint, a vertically extending expansion joint is arranged between the heating wall head and the wall protection plate. During the reconstruction of a part of the heating wall to be restored, the process starts from the old masonry. In praxis, it has been, however, shown that there are always problems with exact determination of the width of the expansion joint between the new brick-laid and not heated heating wall head and the wall protection plate under warming.

This situation occurs especially when several heating wall heads located near one another and having a different number of heating joints must be restored and/or when the position of the system including the wall protection plate-chamber frame is fixed in advance by adjacent heating wall heads which are not to be restored. It was required therefore to accurately calculate the different expansion values for different repair depths so that after heating of the heating wall head it abuts exactly against the wall protection plate and thereby the anchoring forces can be transmitted from the anchoring members to the heating wall. The experience with this solution in the praxis has shown that in many cases it is not possible to calculate in advance the expansion values with the required accuracy.

SUMMARY OF THE INVENTION

Accordingly, it is an object of the present invention to provide a method of restoring heating walls of a coke oven battery, which avoids the disadvantages of the prior art.

In keeping with these objects and with others which will become apparent hereinafter, one feature of the present invention resides, briefly stated, in a method of restoring heating walls of a coke oven battery, which includes the steps of starting with a reconstruction of a part to be renovated on a wall protection plate of the part; abutting a new masonry exactly on the wall protection plate; and arranging between the new masonry and the old masonry a vertically extending welding joint from a ceramic material.

The welding joint is arranged either in the region of the header brick head of the old masonry or in the region of the runner brick of the latter to the heating flue to be restored.

When it is necessary to perform a complete restoration of the heating wall, or in other words, when the heating wall must be restored over the whole length extending from the machine side to the coke side, then in accordance with the present invention the process of wall reconstruction starts in the above-described manner both on the wall protection plate on the machine side and on the coke side. A welding joint is arranged in a head heating flue both on the machine side and on the coke side.

In other words, in the inventive method the expansion joint which was provided conventionally between the heating wall head and the wall protection plate is dispensed with. The function of this expansion joint is taken up by the welding joint which simultaneously also replaces the conventional slip joint between the old and new masonry. In contrast to the expansion joint or the slip joint, the welding joint can be provided with a substantially greater tolerance with respect to its width, since this joint after heating of the heating wall is welded and a sufficient tightness is guaranteed also for greater width. The welding joint with regard to its width must not be exactly calculated in advance, but instead it can be provided with such a great tolerance that the problems during heating up of the restored part of the heating wall cannot occur. The welding of the joint is performed with a refractory ceramic material, such as, for example, silica welding powder.

When a part of the heating wall to be restored has a great length, it can be necessary to arrange in the masonry to be restored additionally one or several vertically extending welding joints, in order to compensate the occurring expansion.

The method in accordance with the present invention has several advantages.

The new masonry abuts always exactly on the wall protection plate. While with the old masonry the expansion joint between the heating wall head and the wall protection plate was protected by laterally extending brick protecting strips, these brick protecting strips can be arrested now by the new masonry on the wall protection plate. Therefore loose brick protecting strips pose no problem.

The anchoring locked during the wall reconstruction can be loosened after the heating up, so that the desired forces can be transferred over the whole height of the wall protection plate simultaneously to the heating wall.

The new masonry is supported during the heating up against the wall protection plate and grows in the direction of the old masonry. Due to this supporting effect, the joint between the heating wall head and the wall protection plate is so tight that no crude gas flow from one coke oven chamber to another coke oven chamber can occur.

With the full renovation of complete side front parts of a battery, which means either coke side or machine side or both sides, the position of the system including the wall protection plate-chamber frame-anchoring post can be exactly determined in advance, without calculating the not-completely tightly closing joint between the heating wall head and the wall protection plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
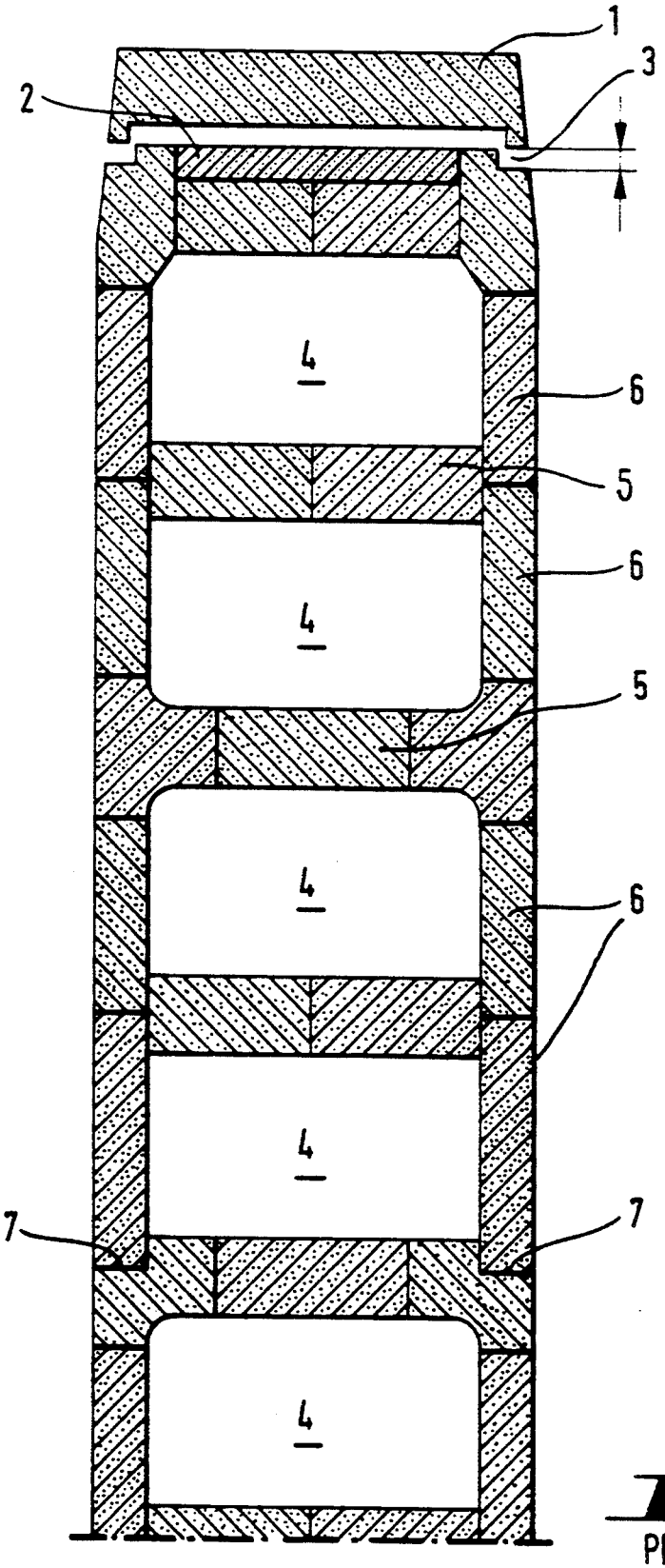
Fig. 1 PRIOR ART
FIG. 1 is a horizontal section of a head part of a heating wall wherein the erection is performed in accordance with the prior art.

FIG. 1 shows a heating wall in which a wall protection plate is identified with reference numeral 1 and a heating wall head is identified with reference numeral 2. An expansion joint 3 is provided between the wall protection plate 1 and the heating wall head 2. The arrows identify the position and the width of the expansion joint in the drawings. The heating wall has a conventional construction. In other words, heating flues 4 are formed by header brick 5, header brick heads 9 and runner bricks 6. In the shown embodiment the renovation of the heating wall extends up to the fifth heating flue. A slip joint 7 is provided between the fourth and fifth heating flue and separates the new masonry from the old masonry. FIG. 1 shows only a part of the heating wall which extends to the beginning of the old masonry. This is the same whether it deals with the part located at the machine side or the part located at the coke side. The structure is the same in both cases.

Figure 2:
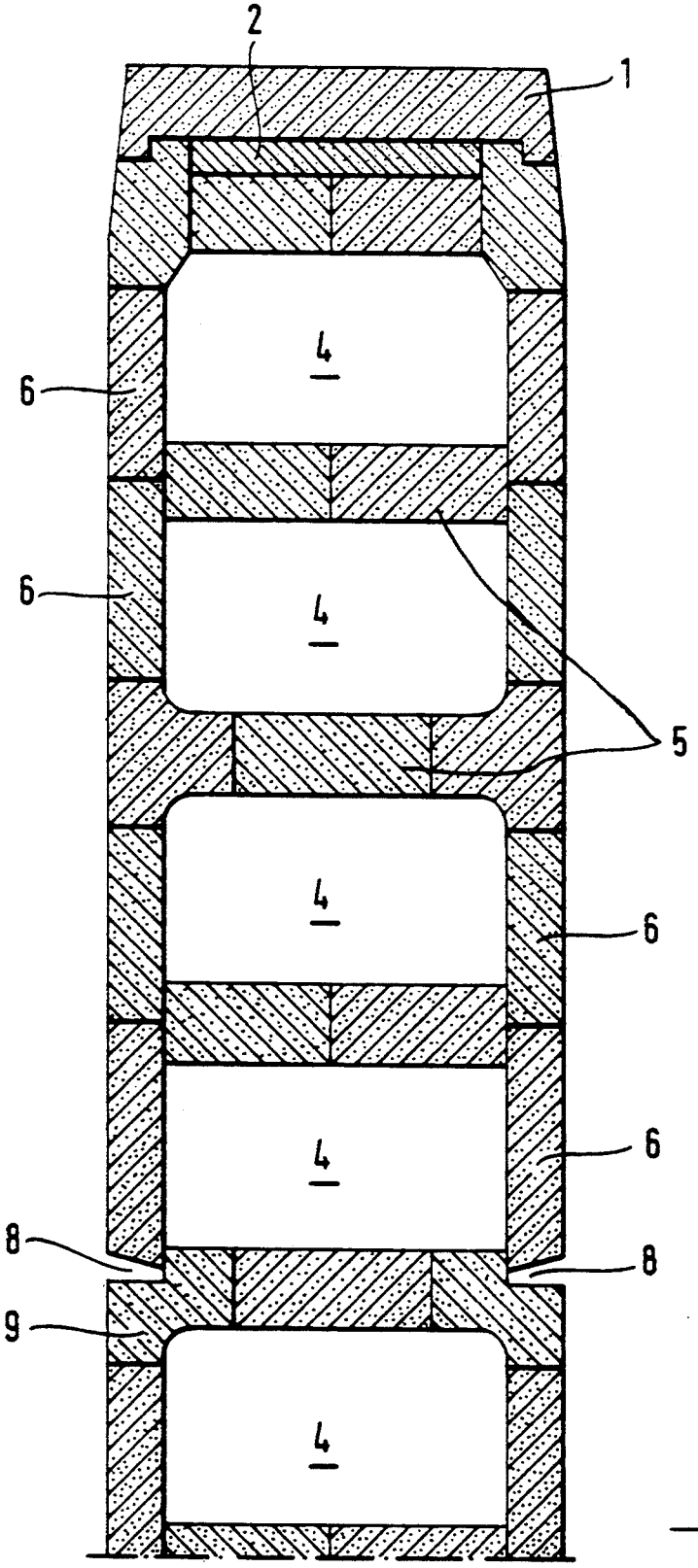
FIG. 2 is a view substantially corresponding to the view of FIG. 1, wherein for erecting the heating wall the method in accordance with the present is utilized.

The heating wall of FIG. 2 substantially corresponds to the heating wall of FIG. 1, and the same reference numerals are utilized for the parts which correspond to the parts of FIG. 1. While in FIG. 1 the erection of the heating wall corresponds to the prior art, the erection of the heating wall of FIG. 2 is performed in accordance with the new inventive process. In accordance with the invention the expansion joint 3 as per FIG. 2 is dispensed with, so that the heating wall head 2 abuts directly against the wall protection plate 1. Instead of the slip joint 7 provided in FIG. 1, a welding joint 8 is provided for sealing the ceramic welding after heating up the new masonry, which means after reaching final thermal expansion of the new masonry. It connects the new masonry with the old masonry. As can be seen from the drawing, the welding joint 8 can be formed substantially wider than the slip joint 7, so that the required tolerances for different expansion ratios of the new masonry and old masonry can be provided without difficulties. The welding guarantees a tightness of the joint which is higher than in the case of a normal slip joint. The welding joint 8 is in this case arranged in the region of the header brick head 9 of the old masonry.

Figure 3:
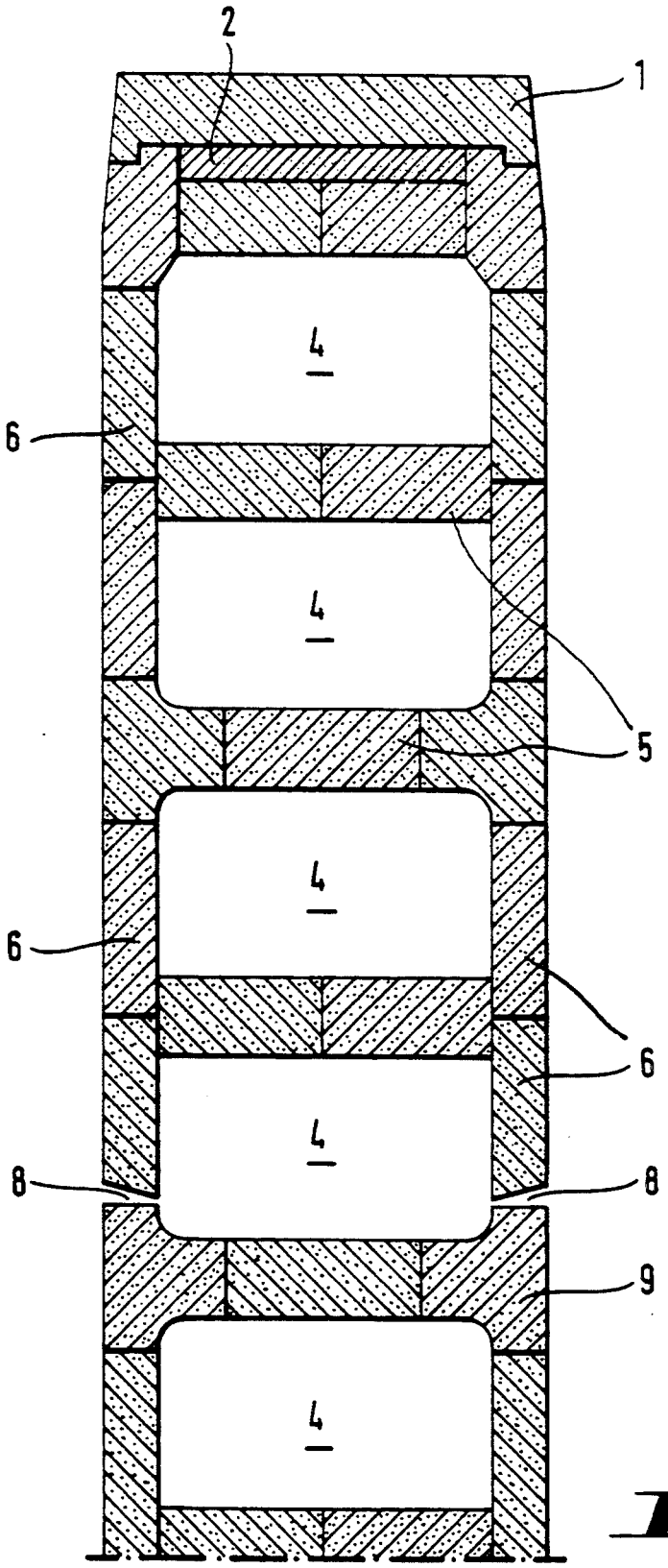
FIG. 3 is a view substantially corresponding to the view of FIG. 1, wherein for erecting the heating wall another variant of the inventive method is utilized.

FIG. 3 finally shows an embodiment in which the welding joint 8 is provided in advance in the region of the runner brick of the last heating flue 4 to be restored.

As is claimed above, the inventive method can be also utilized for full renovation or for new erection of a heating wall. The erection of the heating wall corresponds in principle to the illustrations of FIGS. 2 and 3. In this case the heating wall head 2 abuts directly against the wall protection plate 1 both at the machine side and at the coke side. The welding joint 8 is located in a head heating flue, for example in the third or fourth heating flue.

For reducing the forces acting during the heating onto the wall protection plate, measures can be taken for reducing the friction in the first horizontal slip joint located between the oven floor and the first heating wall layer. The friction can be reduced by applying a sliding medium, for example graphite paste.

It will be understood that each of the elements described above, or two or more together, may also find a useful application in other types of methods differing from the types described above.

While the invention has been illustrated and described as embodied in a method for restoring heating walls of a coke oven battery, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of renovating a portion of heating wall of a coke oven battery, comprising the steps of constructing new masonry starting with the wall head of the wall portion to be renovated and abutting the new masonry exactly on the wall protection plate of the heating wall; and arranging between the new masonry and the old masonry of the heating wall a vertically extending welding joint for sealing by ceramic welding after heating up the new masonry and reaching final thermal expansion of the new masonry.

2. A method as defined in claim 1; and further comprising the step of, additionally to the vertically extending welding joint between the new masonry and the old masonry, arranging at least one vertically extending welding joint in the new masonry for sealing by ceramic welding after the heating up the new masonry and reaching the final thermal expansion of the new masonry.

3. A method of restoring a heating wall of a coke oven battery, comprising the steps of constructing a new masonry over an entire length of the heating wall from a machine side to a coke side; abutting the new masonry exactly on wall protection plates of the wall on the machine side as well as on the coke side; and arranging in the new masonry several vertically extending welding joints for sealing by ceramic welding after heating up the new masonry and after reaching final thermal expansion of the new masonry.

* * * * *